US008201534B2

(12) United States Patent
Sato

(10) Patent No.: US 8,201,534 B2
(45) Date of Patent: Jun. 19, 2012

(54) INTAKE SYSTEM FOR V-TYPE MULTICYLINDER INTERNAL COMBUSTION ENGINE

(75) Inventor: Naoki Sato, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 538 days.

(21) Appl. No.: 12/437,288

(22) Filed: May 7, 2009

(65) Prior Publication Data

US 2009/0277412 A1 Nov. 12, 2009

(30) Foreign Application Priority Data

May 9, 2008 (JP) ..... 2008-123196

(51) Int. Cl.
*F02M 35/10* (2006.01)

(52) U.S. Cl. ..... 123/184.31; 123/184.21; 123/184.23; 123/184.24; 123/184.25; 123/184.34; 123/184.35

(58) Field of Classification Search ..... 123/184.21, 123/184.23, 184.25, 184.34, 184.35
See application file for complete search history.

(56) References Cited

U.S. PATENT DOCUMENTS 2,791,205 A * 5/1957 Platner et al. ..... 123/54.7
2,909,165 A * 10/1959 Dolza ..... 123/184.34
4,577,596 A * 3/1986 Senga ..... 123/184.31
5,901,677 A * 5/1999 Ohrnberger et al. ..... 123/184.31
6,360,724 B1 * 3/2002 Suhre et al. ..... 123/481
6,408,809 B2 * 6/2002 Suzuki ..... 123/184.31
6,659,058 B2 * 12/2003 Ozeki ..... 123/184.34
2001/0029917 A1 * 10/2001 Suzuki ..... 123/184.31
2005/0126531 A1 * 6/2005 Kunugi et al. ..... 123/184.31

FOREIGN PATENT DOCUMENTS

EP 1 860 316 A2 11/2007
JP 06-002628 A 1/1994
JP 07-197865 A 8/1995

* cited by examiner

*Primary Examiner* — Marguerite McMahon
*Assistant Examiner* — James Kim
(74) *Attorney, Agent, or Firm* — Arent Fox, LLP

(57) ABSTRACT

An intake system for a V-type multiple cylinder internal combustion engine includes a plurality of parallel first intake pipes 15L connected to the plurality of cylinders of a first cylinder row, a plurality of parallel second intake pipes 15R connected to the plurality of cylinders of a second cylinder row. The first intake pipes 15L and the second intake pipes 15R extend into an air distribution case 10 so as to extend across each other. A first inlet pipe 13R is provided at a part of a first side wall 11R of the air distribution case 10 corresponding to a substantially middle point of the row of the first intake pipes 15L, and a second inlet pipe 13L is provided at a part of a second side wall 11L of the air distribution case 10 corresponding to a substantially middle point of the row of the second intake pipes 15R. Air flows through the first inlet pipe 13R into the first intake pipes 15L and air flows through the second inlet pipe 13L into the second intake pipes 15R. Dispersion of the amounts of air sucked into the cylinders can be suppressed and the generation of rambling noise can be suppressed.

4 Claims, 3 Drawing Sheets

INTAKE SYSTEM FOR V-TYPE MULTICYLINDER INTERNAL COMBUSTION ENGINE

BACKGROUND OF THE INVENTION

1. Technical Field

The present invention relates to an intake system for a V-type multicylinder internal combustion engine.

2. Description of the Related Art

An intake system for a V-type multicylinder internal combustion engine has been proposed in, for example, JP 7-197865 A. This known intake system includes an air distribution case, namely, a surge tank, disposed between two banks set at an angle to form a V. Intake pipes extend respectively from the intake ports of a plurality of cylinders into the air distribution case and have open ends opening into the air distribution case.

The surge tank of the intake system disclosed in JP-A H7-197865 has an air inlet in one end thereof with respect to a direction parallel to the crankshaft. A throttle body supporting a throttle valve is connected to the air inlet of the surge tank. Air that has flowed through the throttle valve into the surge tank is sucked into the intake pipes arranged in a direction parallel to the crankshaft and is carried to the cylinders.

Since the air inlet is formed in one end of the surge tank with respect to a direction parallel to the crankshaft, the open ends of the intake pipes are at greatly different distances, respectively, from the air inlet with respect to the direction parallel to the crankshaft. Consequently, the amount of air sucked into the intake pipe nearer to the air inlet and that of air sucked into the intake pipe farther from the air inlet are different and the amount of air supplied into the cylinder nearer to the air inlet and that of air supplied to the cylinder farther from the air inlet are different. Thus, the amounts of air supplied to the cylinders are distributed in a wide range.

Since air flows through intake passages of different lengths into the cylinders, rambling intake noise is generated.

SUMMARY OF THE INVENTION

The present invention has been made in view of those problems and it is therefore an object of the present invention to provide an intake system for a V-type multicylinder internal combustion engine, capable of suppressing dispersion of the amounts of air respectively supplied to the cylinders of the V-type multicylinder internal combustion engine and of suppressing the generation of rambling noise.

To attain the above object, the present invention provides an intake system for a V-type multicylinder internal combustion engine having a first bank of cylinders arranged in a first cylinder row, a second bank of cylinders arranged in a second cylinder row set at an angle to form a V, and an air distribution case disposed between the first and the second bank, the intake system comprising:

first intake pipes extending in parallel from the cylinders of the first bank obliquely into the air distribution case and arranged in a row along the first cylinder row;

second intake pipes extending in parallel from the cylinders of the second bank obliquely into the air distribution case and arranged in a row along the second cylinder row;

the first and second intake pipes being arranged alternately so as to extend across each other in the air distribution case and having first open inner ends within the air distribution case and second open inner ends within the air distribution case, respectively;

a first air inlet pipe provided on a first side wall of the air distribution case parallel to the first cylinder row, the first air inlet pipe being positioned at a part of the first side wall of the air distribution case substantially corresponding to a middle of the row of the first intake pipes parallel to the first cylinder row; and a second air inlet pipe provided on a second side wall of the air distribution case parallel to the second cylinder row, the second air inlet pipe being positioned at a part of the second side wall of the air distribution case substantially corresponding to a middle of the row of the second intake pipes parallel to the second cylinder row.

In a preferred embodiment of the present invention, the first open inner ends of the first intake pipes and the second open inner ends of the second intake pipes open in substantially opposite directions, respectively, in the air distribution case, the first open inner ends are arranged parallel to the first cylinder row, the second open inner ends are arranged parallel to the second cylinder row, the first inlet pipe has a center axis thereof intersecting a line segment extending between the respective centers of the open inner ends of the two first intake pipes respectively at the opposite ends of the row of the first intake pipes substantially at a middle of the line segments, and the second inlet pipe has a center axis thereof intersecting a line segment extending between the respective centers of the open inner ends of the two second intake pipes respectively at the opposite ends of the row of the second intake pipes substantially at a middle of the line segments.

Preferably, the first inlet pipe has a substantially oval open end opening into the air distribution case and elongated in a direction parallel to the first cylinder row, and the second air inlet has a substantially oval open end opening into having the open end substantially corresponding to a middle of the row of the first intake pipes parallel to the first cylinder row, and the second inlet pipe having the open end substantially corresponding to a middle of the row of the second intake pipes parallel to the second cylinder row are connected to the opposite side walls of the air distribution case, respectively. Therefore, air flowing through the first inlet pipe does not flow in directions deviated from a direction toward the middle of the row of the first intake pipes and flows toward a space corresponding to the middle of the row of the first intake pipes and hence the dispersion of the amounts of air that flows into the first intake pipes can be suppressed, and air flowing through the second inlet pipe does not flow in directions deviated from a direction toward the middle of the row of the second intake pipes and flows toward a space corresponding to the middle of the row of the second intake pipes and hence the dispersion of the amounts of air that flows into the second intake pipes can be suppressed.

Since the dispersion of the respective lengths of the intake air passages leading to the cylinders is suppressed, the generation of rambling noise can be suppressed.

The space between the first bank of the first cylinders and the second bank of the second cylinders set at an angle to form a V is in a space contained in the angle between the first and the second bank.

The center axis of the first inlet pipe intersects a line segment extending between the respective centers of the open inner ends of the two first intake pipes respectively at the opposite ends of the row of the first intake pipes substantially at the middle of the line segments. Therefore, the amounts of air that flows into the first intake pipes can be equalized to the highest possible extent and hence the dispersion of the amounts of air supplied to the cylinders of the first cylinder row can be still more effectively suppressed.

Similarly, the center axis of the second inlet pipe intersects a line segment extending between the respective centers of the open inner ends of the two second intake pipes respectively at the opposite ends of the row of the second intake pipes substantially at the middle of the line segments. Therefore, the amounts of air that flows into the second intake pipes can be equalized to the highest possible extent and hence the dispersion of the amounts of air supplied to the cylinders of the second cylinder row can be still more effectively suppressed.

Since the first and second inlet pipes provided respectively at the opposite side walls of the air distribution case have center axes inclined in the same direction with respect to a direction parallel to the first and second cylinder rows, air supply pipes connected respectively to the first and second inlet pipes extend in directions parallel to the center axes of the first and second inlet pipes, respectively. Therefore, a dead space is liable to be formed between the air supply pipes on the side of the air supply pipes. The air distribution case is bulged into the dead space in the direction in which the respective center axes of the first and second inlet pipes are inclined, devices arranged on the periphery of the engine body of the internal combustion engine can be compactly arranged, and the migration of air between a space on the side of the first inlet pipe and a space on the side of the second inlet pipe in the air distribution case can be improved and air suction efficiency can be improved.

In the internal combustion engine provided with the cylinder deactivating mechanism, the cylinders of the end groups of the first cylinder row and the cylinders of the middle group of the second cylinder row are deactivated when the internal combustion engine is in specific operating modes. When those cylinders are deactivated, air flows through the first inlet pipes into a space corresponding to the middle of the row of the first intake pipes connected to the non-deactivated cylinders to equalize the amounts of air that flows into the first intake pipes and air flows through the second inlet pipes into a space corresponding to the middle of the row of the second intake pipes connected to the non-deactivated cylinders to suppress the dispersion of the amounts of air supplied to the cylinders.

DESCRIPTION OF THE PREFERRED EMBODIMENT

An intake system in a preferred embodiment of the present invention will be described with reference to FIGS. 1 to 4.

In the description of the preferred embodiment, words including front, forward and such are used to indicate a direction, a position and parts on the moving direction of the vehicle, and words including front, rear, right and left are used to indicate the front, the rear, the right and the left of the vehicle body, respectively.

Figure 1:
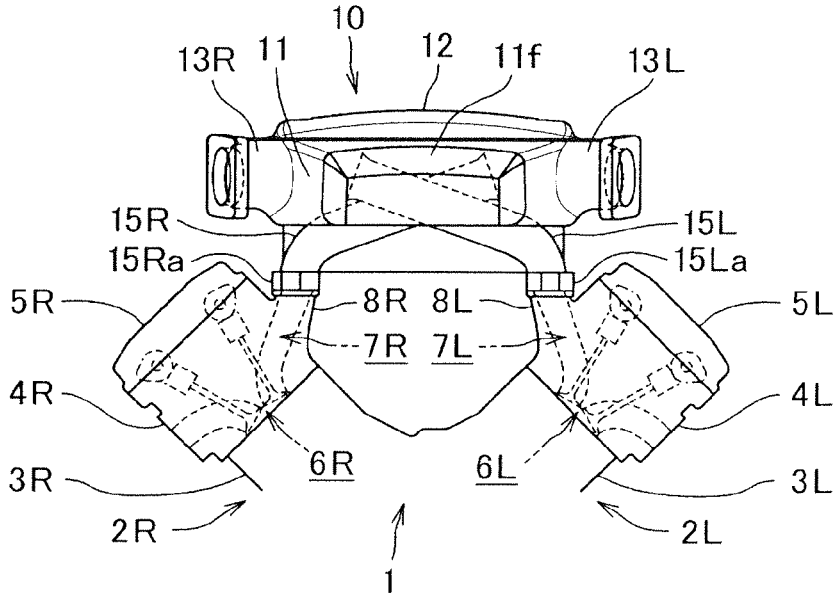
FIG. 1 is a front elevation of an intake system in a preferred embodiment according to the invention and a V-type 8-cylinder internal combustion engine with certain parts omitted.

An internal combustion engine in the embodiment of the present invention is a water-cooled 4-stroke cycle V-8 internal combustion engine 1. The V-8 internal combustion engine 1 is mounted on a vehicle body with its crankshaft directed parallel to the longitudinal axis of the vehicle body. The V-8 internal combustion engine 1 has a first or left bank 2L of cylinders arranged in a row, and a second or right bank 2R of cylinders arranged in a row. The right bank 2R and the left bank 2L are set at an angle to form a V as shown in FIG. 1.

Figure 2:
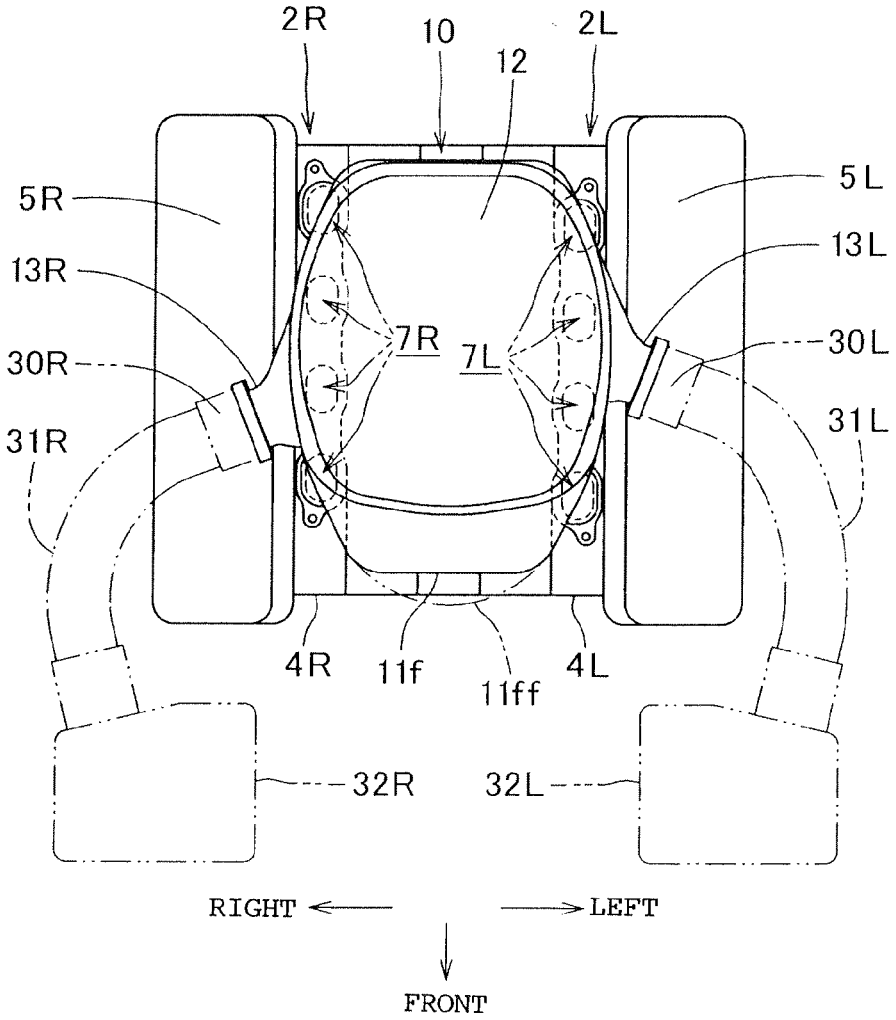
FIG. 2 is a top plan view of the intake system and the V-type 8-cylinder internal combustion engine shown in FIG. 1.

Four cylinders 3R are arranged in a row in the right bank 2R. Four cylinders 3L are arranged in a row in the left bank 2L. The left bank 2L is slightly displaced forward relative to the right bank 2R as shown in FIG. 2. The right and the left side in FIG. 2 are reverse to the right and the left side with respect to the vehicle body, respectively.

A right cylinder head 4R and a left cylinder head 4L are put on and fastened to the right bank 2R and the left bank 2L, respectively. The right cylinder head 4R and the left cylinder head 4L are covered with a right cylinder head cover 5R and a left cylinder head cover 5L, respectively. The cylinders 3L of the left bank 2L, the left cylinder head 4L and the left cylinder head cover 5L, and the cylinders 3R of the right bank 2R, the right cylinder head 4R and the right cylinder head cover 5R are set at an angle to form a V.

Right intake ports 7R and left intake ports 7 extend from right combustion chambers 6R and left combustion chambers 6L through the right cylinder head 4R and the left cylinder head 4L, respectively, toward a space between the right bank 2R and the left bank 2L set at an angle to form a V.

Each of the right intake ports 7R and the left intake ports 7L has a pair of separate open ends opening into the corresponding one of the combustion chambers 6R and 6L and merging into a single upper part. Thus the right bank 2R and the left bank 2L are provided with the four right intake ports 7R and the four left intake ports 7L, respectively.

The open upper ends of the four intake ports 7R of the right bank 2R and the four intake ports 7L of the left bank 2L form intake pipe connecting parts 8R and 8L, respectively. Each of the intake pipe connecting parts 8R and 8L has a horizontal open ends having a longitudinally elongate shape.

An air distribution case 10 is disposed in a space between the right bank 2R and the left bank 2L. The air distribution case 10 is supported by first intake pipes 15L and second intake pipes 15R connected to the left intake pipe connecting parts 8L and the right intake pipe connecting parts 8R, respectively.

Figure 3:
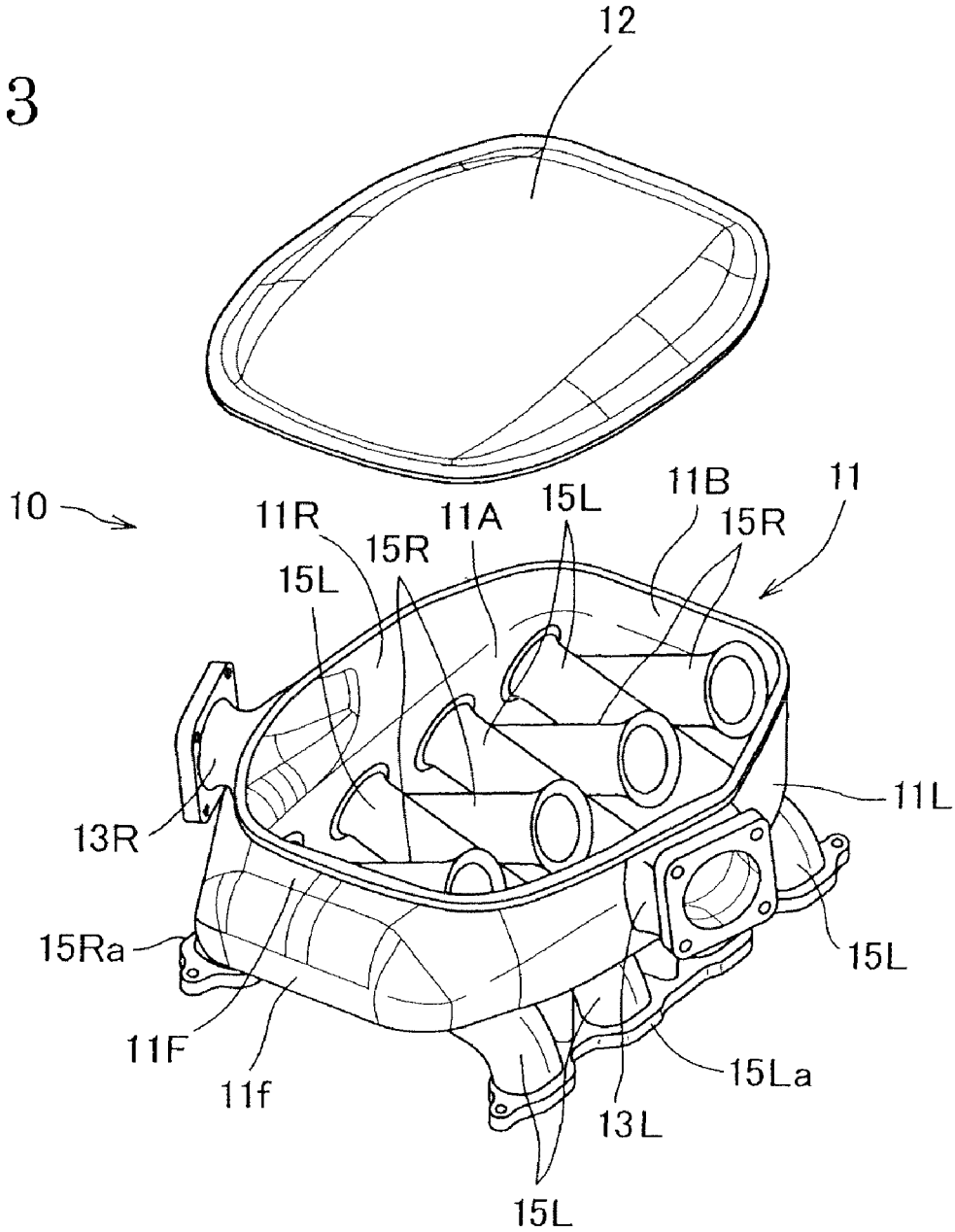
FIG. 3 is an exploded perspective view of an air distribution case.

As shown in FIG. 3, the air distribution case 10 is made up of a case body 11 having the shape of a vessel, and a cover 12 covering the open upper end of the case body 11.

The case body 11 has a longitudinally elongate, substantially rectangular bottom wall 11A, a front side wall 11F, a rear side wall 11B, a right side wall 11R and a left side wall 11L rising from the front, rear, right and left sides of the bottom wall 11A. The case body 11 is a vessel having the shape of a substantially longitudinally elongate rectangular solid.

The cover 12, like the bottom wall 11A of the case body 11, has a substantially rectangular shape and is provided with a flange. The flange of the cover 12 is joined and fastened to a flange formed in the upper open end of the case body 11 with bolts or the like, so as to cover the upper open end of the case body 11.

A first air inlet pipe 13R and a second air inlet pipe 13L extend outward from the right side wall 11R and the left side wall 11L, respectively. The first air inlet pipe 13R and the second air inlet pipe 13L have the shape of an elliptic cylinder and have oval open ends by means of which the internal space of the air distribution case 10 communicates with the external space. The oval open ends of the first inlet pipe 13R and the second inlet pipe 13L are elongate in a direction parallel to the right cylinder bank 2R and the left cylinder bank 2L.

The front side wall 11F of the case body 11 has a forwardly bulged part 11*f*.

Four first intake pipes 15L are connected to the longitudinally arranged intake pipe connecting parts 8L of the left bank 2L, and four second intake pipes 15R are connected to the longitudinally arranged intake pipe connecting parts 8R of the right bank 2R. These first intake pipes 15L and second intake pipes 15R extend into the air distribution case 10 through the bottom wall 11*a* of the case body 11.

Four horizontal outer ends of the first intake pipes 15L to be connected to the intake pipe connecting parts 8L of the left bank 2L form a common horizontal left flange 15La. The four first intake pipes 15L rise from the common left flange 15La and are curved rightward, (leftward as viewed in FIG. 1) so as to extend obliquely upward parallel to each other. The four first intake pipes 15L extend through the bottom wall 11A of the case body 11 into the air distribution case 10. The first open ends 15Lb (FIG. 4), namely, the open inner ends, of the first intake pipes 15L open into the case body 11 substantially toward the right.

Similarly, four horizontal outer ends of the second intake pipes 15R to be connected to the intake pipe connecting parts 8R of the right bank 2R are connected to a common horizontal right flange 15Ra. The four second intake pipes 15R rise from the common right flange 15Ra and are curved leftward, (rightward as viewed in FIG. 1) so as to extend obliquely upward parallel to each other. The four second intake pipes 15R extend through the bottom wall 11A of the case body 11 into the air distribution case 10. The second open ends 15Rb, namely, the open inner ends, of the second intake pipes 15R open into the case body 11 substantially toward the left.

Figure 4:
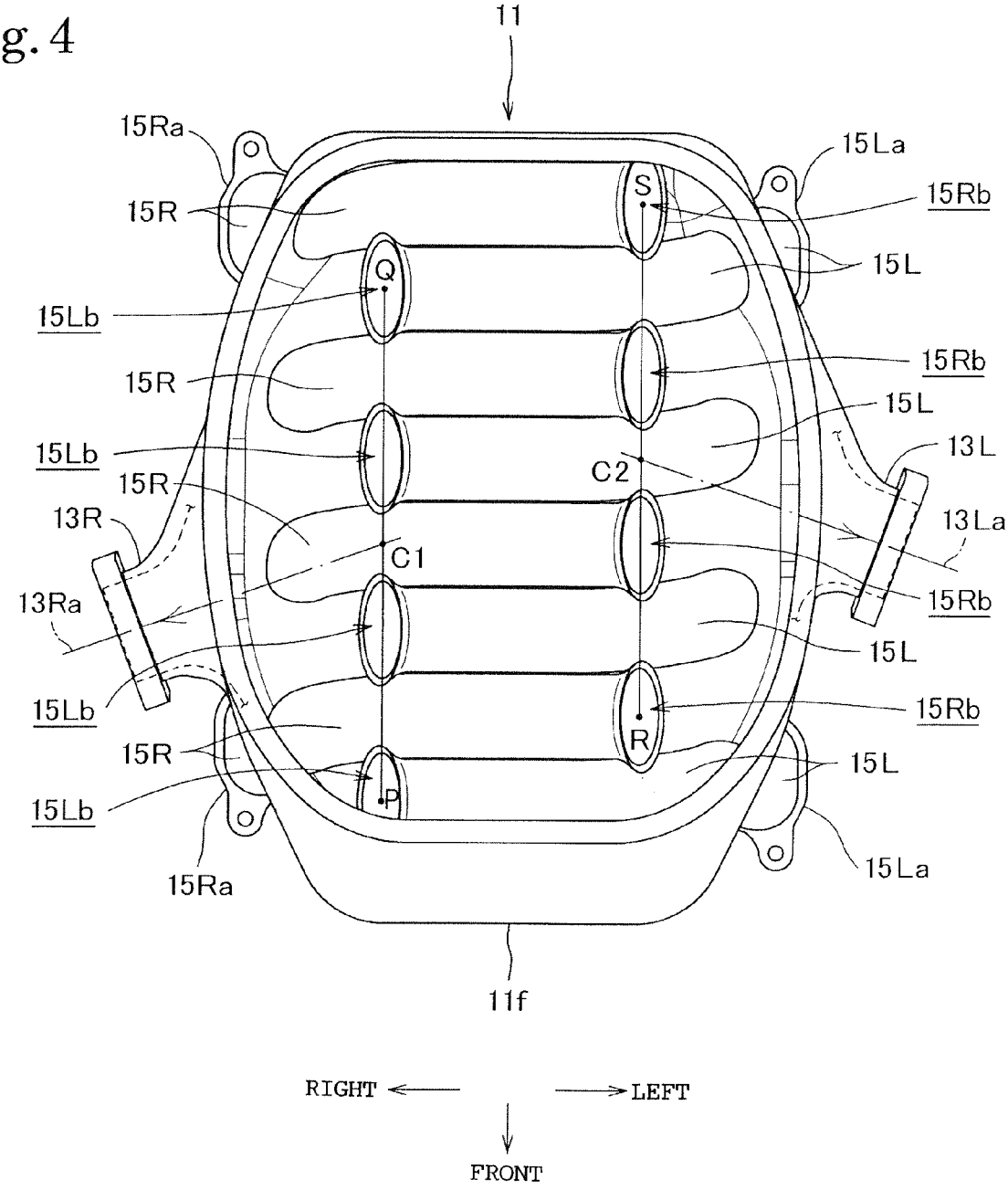
FIG. 4 is a top plan view of a case body included in the air distribution case.

The four first intake pipes 15L extending toward the right from the left bank 2L and the four second intake pipes 15R extending toward the left from the right bank 2R are arranged alternately so as to extend across each other in the case body 11. Referring to FIGS. 3 and 4, the first open ends 15Lb of the first intake pipes 15L are arranged in a longitudinal row in the right part of the interior of the case body 11 and the second open ends 15Rb of the second intake pipes 15R are arranged in a longitudinal row in the left part of the interior of the case body 11.

As shown in FIGS. 3 and 4, the row of the first intake pipes 15L is displaced forward relative to the row of the second intake pipes 15R similarly to the positional relation between the left bank 2L and the right bank 2R. The first intake pipes 15L and the second intake pipes 15R are arranged alternately so as to extend across each other in the air distribution case 10.

Referring to FIG. 4 showing the case body 11 in a top plan view, the first inlet pipe 13R is connected to a part of the right side wall 11R of the case body 11 substantially corresponding to the middle of the longitudinal row of the four first intake pipes 15L parallel to the first cylinder row (parallel to the crankshaft). The open inner end of the first inlet pipe 13R is substantially opposite the first open ends 15Lb of the first intake pipes 15L.

Similarly, the second inlet pipe 13L is connected to a part of the left side wall 11L of the case body 11 substantially corresponding to the middle of the longitudinal row of the four second intake pipes 15R. The open inner end of the second inlet pipe 13L is substantially opposite the second open ends 15Rb of the second intake pipes 15R.

Since the first intake pipes 15L are displaced forward relative to the second intake pipes 15R and the first intake pipes 15L and the second intake pipes 15R extend across each other, the first inlet pipe 13R is displaced slightly forward relative to the second inlet pipe 13L.

The first inlet pipe 13R and the second inlet pipe 13L have open outer ends facing obliquely forward.

As shown in FIG. 4, the respective center axes 13Ra and 13La of the first inlet pipe 13R and the second inlet pipe 13L having the shape of an elliptic cylinder are inclined forward to the outer surfaces of the right and the left side wall of the case body 11 outside the case body 11, respectively.

The center axis 13Ra of the first inlet pipe 13R intersects a line segment PQ (FIG. 4) extending between the respective centers of the open ends 15Lb of the two first intake pipes 15L respectively at the opposite ends of the row of the first intake pipes 15L substantially at the middle point C1 of the line segment PQ. Thus, the first inlet pipe 13R corresponds substantially to the middle of the row of the first intake pipes 15L parallel to the first or left bank 2L.

Similarly, the center axis 13La of the second inlet pipe 13L intersects a line segment RS (FIG. 4) extending between the respective centers 15Rb of the open ends of the two second intake pipes 15R respectively at the opposite ends of the row of the second intake pipes 15R substantially at the middle point C2 of the line segments RS. Thus, the second inlet pipe 13L corresponds substantially to the middle of the row of the second intake pipes 15R parallel to the second or right bank 2R.

The air distribution case 10 constructed as above is arranged in the space between the two banks of the V-8 internal combustion engine 1 in a manner below.

The common left flange 15La, to which the left intake pipes 15L extending obliquely downward from the bottom wall 11*a* of the air distribution case 10 are connected, is joined to the intake pipe connecting parts 8L projecting from the cylinder head 4L into the space between the banks 2R and 2L, while the common right flange 15Ra, to which the right intake pipes 15R extending obliquely downward from the bottom wall 11*a* of the air distribution case 10 are connected, is joined to the intake pipe connecting parts 8R projecting from the cylinder head 4R into the space between the banks 2R and 2L, whereby the air distribution case 10 is supported on the internal combustion engine 1.

As mentioned above, the respective center axes 13Ra and 13La of the first inlet pipe 13R and the second inlet pipe 13L are inclined forward to the outer surfaces of the right and the left side wall of the case body 11, respectively. A right throttle body 30R and a left throttle body 30L are connected to the first inlet pipe 13R and the second inlet pipe 13L, respectively, and the throttle bodies 30R and 30L are connected to air cleaners 32R and 32L by a forwardly curved second air supply pipe 31R and a forwardly curved first air supply pipe 31L, respectively, as indicated by two-dot chain lines in FIG. 2.

Since the air supply pipes 31R and 31L extend forward from substantially the middle parts of the right side wall 11R and the left side wall 11L of the air distribution case 10, respectively, a dead space is liable to be formed between the air supply pipes 31R and 31L in front of the air distribution case 10. The forward bulged part 11*f* of the front side wall 11F of the case body 11 is formed in the dead space.

The intake system of the V-8 internal combustion engine 1 is thus formed. Air to be supplied to the cylinders 3R and 3L respectively having the combustion chambers 6R and 6L flows from the air cleaners 32R and 32L through the air supply pipes 31R and 31L, the throttle bodies 30R and 30L and the inlet pipes 13R and 13L into the air distribution case 10.

Most of air flowing through the first inlet pipe 13R into the air distribution case 10 is sucked through the four first open ends 15Lb substantially opposite the first inlet pipe 13R into the four cylinders 3L having the combustion chambers 6L of the left bank 2L. Most of air flowing through the second inlet pipe 13L into the air distribution case 10 is sucked through the four second open ends 15Rb substantially opposite the second inlet pipe 13L into the four cylinders 3R having the combustion chambers 6R of the right bank 2R.

The first inlet pipe 13R is connected to a part of the right side wall 11R of the case body 11 substantially corresponding to the middle of the longitudinal row of the four first intake pipes 15L parallel to the crankshaft. The first inlet pipe 13R is attached to the right side wall 11R such that the center axis 13Ra thereof intersects the line segment PQ extending between the respective centers of the open ends 15Lb of the two first intake pipes 15L respectively at the opposite ends of the row of the first intake pipes 15L substantially at the middle point C1 of the line segment PQ. Thus, air flowing into the first intake pipes 15L are equalized to the highest possible extent and the dispersion of the amounts of air supplied to the four cylinders of the left bank 2L can be suppressed.

Similarly, the second inlet pipe 13L is connected to a part of the left side wall 11L of the case body 11 substantially corresponding to the middle of the longitudinal row of the four second intake pipes 15R parallel to the crankshaft. The second inlet pipe 13L is attached to the left side wall 11L such that the center axis 13La thereof intersects the line segment RS extending between the respective centers of the open ends 15Rb of the two second intake pipes 15R respectively at the opposite ends of the row of the second intake pipes 15R substantially at the middle point C2 of the line segment RS. Thus, air flowing into the second intake pipes 15R are equalized to the highest possible extent and the dispersion of the amounts of air supplied to the four cylinders of the right bank 2R can be suppressed.

As mentioned above, the forward bulged part 11*f* of the front side wall 11F of the case body 11 is formed in the dead space between the air supply pipes 31R and 31L extending forward from the right side wall 11R and the left side wall 11L, respectively, of the air distribution case 10. Therefore, devices on the periphery of the engine body can be compactly arranged, and the flow of air between a space on the side of the first open ends 15Lb and a space on the side of the second open ends 15Rb in the air distribution case 10 can be improved and air suction efficiency can be improved.

As indicated by two-dot chain lines in FIG. 2, another bulged part 11*ff* can be formed by further bulging a part of the bulged part 11*f* forward. By doing so, the area of an imaginary boundary plane between the right side space and the left side space in the air distribution case 10 can be increased without greatly increasing the volume of the bulged part of the air distribution case 10 to promote the migration of air across the imaginary boundary plane.

When the V-8 internal combustion engine 1 is provided with a cylinder deactivating mechanism, the two end cylinders (or the two middle cylinders) of the left bank 2L and the two middle cylinders (or the two end cylinders) of the right bank 2 are used as deactivated cylinders and the four other cylinders are used as normally operating cylinders.

Air flows into the middle of a space between the first open ends 15Lb of the two first intake pipes 15L connected to the two working middle cylinders (or the two working end cylinders) of the left bank 2L when the cylinder deactivating mechanism operates, and the amounts of air that flows into the two middle first intake pipes 15L are equalized. Similarly, air flows into the middle of a space between the second open ends 15Rb of the two second intake pipes 15R connected to the two working middle cylinders (or the two working end cylinders) of the right bank 2R when the cylinder deactivating mechanism operates, and the amounts of air that flows into the two middle second intake pipes 15R are equalized. Thus the dispersion of the amounts of air that flows into the cylinders can be suppressed.

The number of the end cylinders at one end of each bank and the number of the end cylinders at the other end of the bank are required to be the same, and this number need not necessarily be two. The number of the end cylinders at each end of the each bank is determined appropriately based on the number of cylinders of the engine. In a V-12 internal combustion engine, for example, the number of end cylinders at each end of each bank is two, for example. In this case, the number of middle cylinders of each bank is two.

Suppression of the dispersion of the amounts of air that flows into the cylinders suppresses the generation of rambling noise.

The present invention is applicable to V-type multicylinder internal combustion engine having a first bank of a plurality of cylinders and a second bank of a plurality of cylinders other than the V-8 internal combustion engine. The cylinders of each of the first and the second bank are divided into two end groups of the same number of the cylinders and one middle group of the cylinders. Even if the cylinders of the two end groups of the first bank and the cylinders of the middle group of the second bank are deactivated by the cylinder deactivating mechanism when the V-type multicylinder internal combustion engine is in a specific operating mode, air flows through the first inlet pipe to the middle of the row of the first intake pipes connected to the working cylinders so that equal amounts of air may flow into the first intake pipes and air flows through the second inlet pipe to the middle of the row of the second intake pipes connected to the working cylinders so that equal amounts of air may flow into the second intake pipes. Thus, the dispersion of the amounts of air that flows into the cylinders can be suppressed.

What is claimed is:

1. A V-type multicylinder internal combustion engine having a first bank of cylinders arranged in a first cylinder row, a second bank of cylinders arranged in a second cylinder row set at an angle to form a V, and an intake system including an air distribution case disposed between the first and the second banks, said intake system comprising:

first intake pipes extending in parallel from the cylinders of the first bank obliquely into the air distribution case and arranged in a row along the first cylinder row;

second intake pipes extending in parallel from the cylinders of the second bank obliquely into the air distribution case and arranged in a row along the second cylinder row;

the first and second intake pipes being disposed and arranged alternately within the air distribution case so as to extend across each other into the air distribution case and having first open inner ends within the air distribution case and second open inner ends within the air distribution case, respectively;

a first air inlet pipe provided on a first side wall of the air distribution case parallel to the first cylinder row, the first air inlet pipe being positioned at a part of the first side wall of the air distribution case substantially corresponding to a middle of the row of the first intake pipes parallel to the first cylinder row; and a second air inlet pipe provided on a second side wall of the air distribution case parallel to the second cylinder row, the second air inlet pipe being positioned at a part of the second side wall of the air distribution case substantially corresponding to a middle of the row of the second intake pipes parallel to the second cylinder row, wherein the first open inner ends of the first intake pipes and the second open inner ends of the second intake pipes open in substantially opposite directions, respectively, in a space within the air distribution case;

the first inlet pipe has a center axis intersecting a first line segment extending between respective centers of the first open inner ends of the first intake pipes located at opposite ends of the row of the first intake pipes, the center of axis of the first inlet pipe intersecting the first line segment at substantially a middle point thereof; and the second inlet pipe has a center axis intersecting a second line segment extending between respective centers of the second open inner ends of the second intake pipes located at opposite ends of the row of the second intake pipes, the center of axis of the second inlet pipe intersecting the second line segment at substantially a middle point thereof;

the cylinders of each of the first and second cylinder rows are divided into two end groups of the same number of the cylinders and one middle group of the cylinders other than the cylinders of the end groups with respect to a direction parallel to the cylinder rows; and the engine is provided with a cylinder deactivating mechanism for deactivating the cylinders of the two end groups of the first cylinder row and the cylinders of the middle group of the second cylinder row when the internal combustion engine is in a specific operating mode.

2. The V-type multicylinder internal combustion engine, according to claim 1, wherein the first and second inlet pipes have the shape of an elliptic cylinder and have oval open ends opening into the air distribution case and being elongated in a direction parallel to the first and second cylinder rows.

3. The V-type multicylinder internal combustion engine, according to claim 1, wherein the first and second inlet pipes have center axes thereof inclined to the first and second side walls, respectively, in the same direction with respect to a direction parallel to the first and second cylinder rows; and the air distribution case bulges out in the direction in which the center axes of the first and second inlet pipes are inclined.

4. The V-type multicylinder internal combustion engine, according to claim 1, further comprising:

a first bulged part extending away from a front side wall of the air distribution case and a second bulged part extending away from the first bulged part, wherein the first and second inlet pipes have center axes thereof inclined to the first and second side walls, respectively, in the same direction with respect to a direction parallel to the first and second cylinder rows; and the center axes of the first and second inlet pipes are inclined in a direction in which the first and second bulged parts extend.

* * * * *